US006818070B2

(12) United States Patent
Rosenberg

(10) Patent No.: US 6,818,070 B2
(45) Date of Patent: Nov. 16, 2004

(54) METHOD OF COLLECTING AND DISPOSING WINE EXPECTORANT FROM SPIT BUCKETS AND APPARATUS THEREFOR

(76) Inventor: Neil A. Rosenberg, 15 Starbrook Dr., Barrington, RI (US) 02806

( * ) Notice: Subject to any disclaimer, the term of this patent is extended or adjusted under 35 U.S.C. 154(b) by 323 days.

(21) Appl. No.: 10/140,163

(22) Filed: May 8, 2002

(65) Prior Publication Data

US 2003/0208876 A1 Nov. 13, 2003

(51) Int. Cl.[7] ..... A47L 5/00

(52) U.S. Cl. ..... 134/21; 15/327.5; 15/409; 141/65

(58) Field of Search ..... 15/327.5, 409; 141/65; 134/21

(56) References Cited

U.S. PATENT DOCUMENTS

| | | | | | |
|---|---|---|---|---|---|
| 997,864 | A | | 7/1911 | Simpson | |
| 3,039,463 | A | | 6/1962 | Dickey, Jr. et al. | |
| 3,165,774 | A | * | 1/1965 | Barba | 15/323 |
| 3,331,090 | A | | 7/1967 | Reiber et al. | |
| 3,562,846 | A | * | 2/1971 | Creamer et al. | 15/353 |
| 4,570,685 | A | * | 2/1986 | Taylor | 141/61 |
| 5,134,994 | A | | 8/1992 | Say | |
| 5,142,730 | A | | 9/1992 | Braks et al. | |
| 5,924,166 | A | | 7/1999 | Jones et al. | |
| 5,989,360 | A | | 11/1999 | Hamilton | |
| 6,094,778 | A | | 8/2000 | Boukas | |
| 6,564,422 | B2 | * | 5/2003 | Nakabayashi | 15/344 |

* cited by examiner

*Primary Examiner*—Theresa T. Snider
(74) *Attorney, Agent, or Firm*—Burns, Doane, Swecker & Mathis, LLP

(57) ABSTRACT

To dispose wine expectorant from a spit bucket, the interior of a portable pressurizable rigid tank is connected to a vacuum pump which draws a vacuum in the tank. The tank is disconnected from the pump and transported to the spit bucket. An inlet end of a suction conduit connected to the tank is inserted into the spit bucket. A passage from the inlet end to the tank interior is opened to cause the vacuum in the tank to draw-in the wine expectorant from the spit bucket. The tank is taken to a discharge station, and a drain of the tank is opened in order to discharge the tank contents.

10 Claims, 2 Drawing Sheets

METHOD OF COLLECTING AND DISPOSING WINE EXPECTORANT FROM SPIT BUCKETS AND APPARATUS THEREFOR

BACKGROUND OF THE INVENTION

The present invention relates to a wine expectorant disposal method and apparatus. In particular, the invention relates to a portable pumpless vacuum apparatus and method of use.

At a wine-tasting event, where people sample numerous wines, it is necessary for the tasters to spit-out the samples in order to be able to taste numerous wines without being overcome by the effects of alcohol. At large events of this type, there are many tables at which wine is tasted, each table having its own spit bucket. When full, the spit-buckets are carried to a disposal station and emptied. This is an unpleasant task, requiring that handlers maneuver through a crowd, while trying not to spill the contents of the bucket onto any patrons of the event.

It would be desirable to enable spit buckets to be emptied in a less unpleasant and more sanitary way.

SUMMARY OF THE INVENTION

One aspect of the present invention relates to a portable, pumpless wine expectorant vacuum device which comprises a pressurizable rigid tank having a valved vacuum access adapted to be connected to a separate suction pump for drawing a vacuum in the tank. A valve suction conduit is connected to the tank for enabling wine expectorant to be sucked into the tank by the vacuum. A valved drain is disposed on the tank for emptying the tank.

Preferably, a vacuum conduit communicates with the vacuum access and includes a one way valve exposed at a free end thereof for connection with the suction pump. Also, it is preferred that the drain be disposed at a lower portion of the tank, and that a discharge hose be connected to the drain.

Another aspect of the invention relates to a method of disposing wine expectorant from a spit bucket. The method comprises the steps of:

A) connecting an interior of a portable pressurizable rigid tank to a vacuum pump and actuating the pump for drawing a vacuum in the tank;

B) disconnecting the tank from the pump;

C) transporting the tank away from the pump and to the spit bucket;

D) inserting into the spit bucket an inlet end of a suction conduit connected to the tank and opening a passage from the inlet end to the tank interior to cause the vacuum in the tank to draw-in wine expectorant from the spit bucket; and E) transporting the tank to a discharge station and opening a drain of the tank to discharge the contents of the tank.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF A PREFERRED EMBODIMENT OF THE INVENTION

Figure 1:
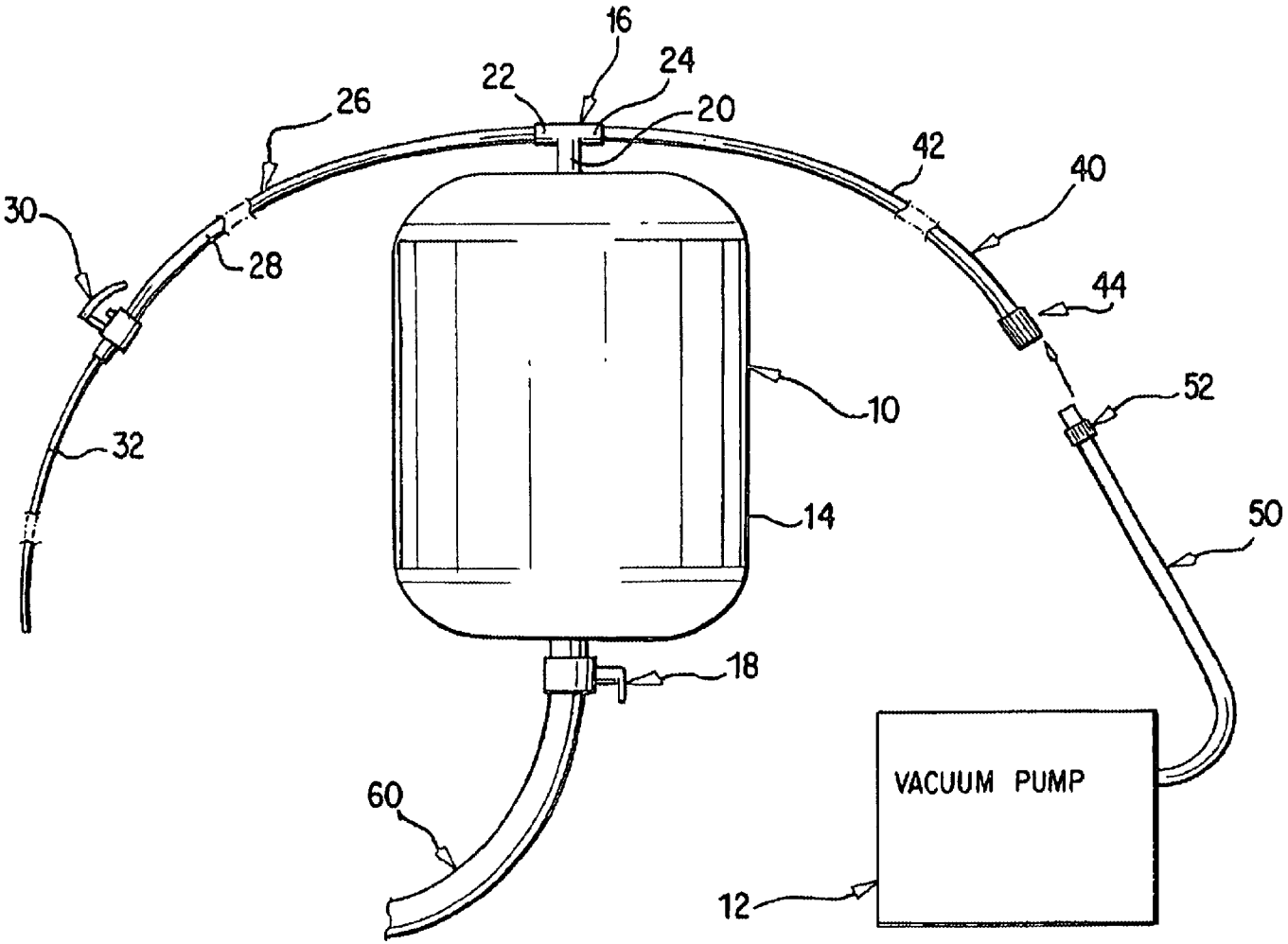
FIG. 1 is a view of a wine expectorant removal system according to the present invention which includes a portable pressurizable rigid tank and a separate suction pump.

Depicted in FIG. 1 is an expectorant disposal system which includes a portable, pumpless vacuum device 10 and a separate vacuum pump 12. The vacuum device 10 comprises a rigid tank 14 which is pressurizable, i.e. pressurizable to a negative pressure. The tank 14 has a T-fitting 16 disposed at it upper end, and a drain valve 18 disposed its lower end.

The fitting forms three ports 20, 22, 24. A first of the ports 20 communicates with an interior of the tank 14, and second and third ones 22, 24 of the ports communicate with the first port 20.

A flexible suction conduit 26 includes a suction hose 28 connected to the second port 22, a manually actuable valve 30 at a free end of the hose 28, and a relatively stiff wand 32 connected to the valve 30.

A vacuum conduit 40 includes a vacuum hose 42 connected the third port 24, and a conventional one-way valve 44 disposed at a free end of the hose 42.

The vacuum pump 12 includes a hose 50 carrying a fitting 52 at a free end thereof. The fitting 52 comprises a conventional male element which can be connected to the one-way valve 44 to automatically open the valve 44 (which valve 44 is automatically closed when not connected to the fitting 52).

A drain conduit 60 is connected to the drain valve 18.

Figure 2:
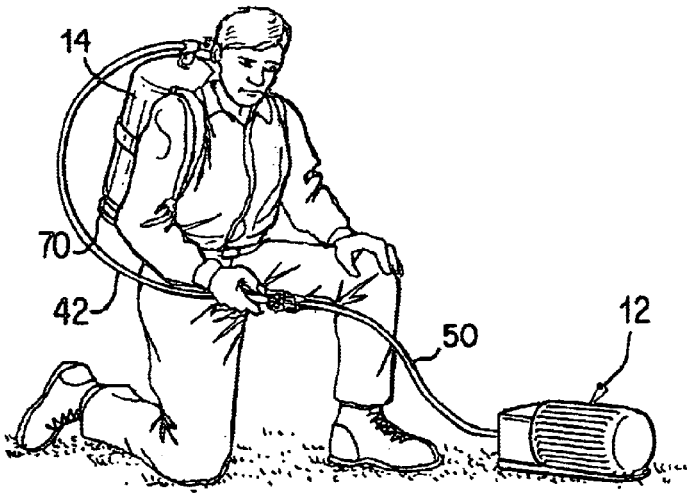
FIG. 2 depicts a user performing the step of generating a vacuum within the tank.
Figure 3:
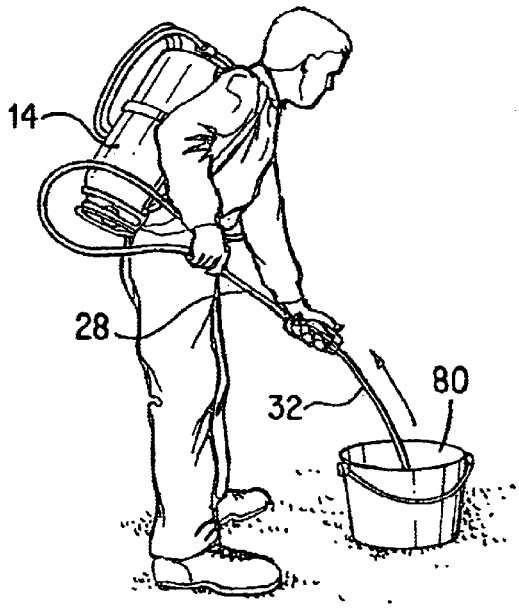
FIG. 3 depicts a user causing wine expectorant to be sucked from a spit bucket into the tank.

In use at a wine tasting event, the tank 14 is transported to the vacuum pump 12. For example, the tank could be mounted on a harness 70 capable of being worn on a user's back as shown in FIG. 2. The user connects the valve 44 to the fitting 52 of the hose 50, whereupon the valve 44 is opened, enabling the vacuum pump to be activated to draw a vacuum in the tank (e.g. 30 inches of mercury). The valves 18 and 30 are closed at this time.

Then, the tank is disconnected from the pump 12, whereupon the valve 44 automatically closes, and the tank is transported to a series of expectorant vessels or spit buckets 80. The user inserts the wand 32 into a first spit bucket 80 and then opens the valve 30, enabling the tank vacuum to draw expectorant into the tank, as shown in FIG. 2. The tank can be sized to hold any desired amount of liquid that can be conveniently carried by the user, e.g., three gallons.

Figure 4:
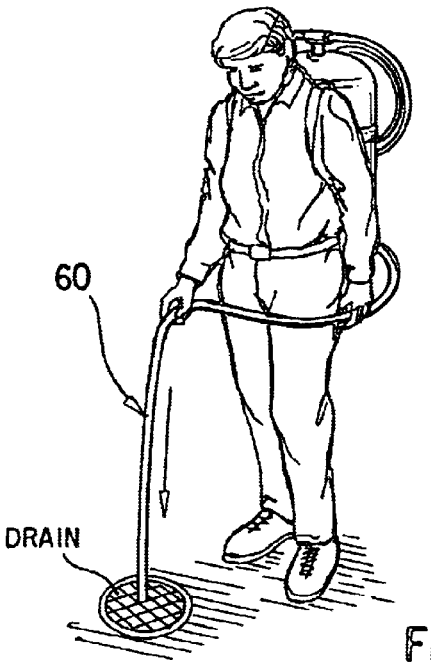
FIG. 4 depicts the user discharging the contents of the tank.

Then the tank can be transported to one or more additional spit buckets where the suction procedure is repeated. Once full of liquid, the tank is carried to a disposal station, as shown in FIG. 4, whereupon the drain valve 18 is opened to enable liquid to drain from the tank through the drain conduit 60.

It will be appreciated that the invention eliminates the need to manually carry spit-buckets through a crowd at a wine-tasting event. Attention is directed to the fact that portable vacuum pump units have been proposed which include an electrically driven pump (e.g., see U.S. Pat. Nos. 3,331,090; 5,134,994; and 5,142,730) which are of increased weight due to the presence of the pump. The pumps can be connected to a remote electric source by a cord, thereby having a restricted range of use. Alternatively, the pump can be battery-operated, thereby being even heavier and more expensive. Those shortcomings are all avoided by the present invention.

It will also be appreciated that the valves that are used in the present invention can be of any suitable type. Note that while the vacuum 40 conduit provides the convenience of enabling a user to easily connect the tank to the vacuum pump while wearing the tank, the conduit 40 could be eliminated if the hose 50 were connected directly to the port 24. Also, the drain conduit 60 could be eliminated if it is preferred to position the valve 18 directly over a drain when opening the valve. The hoses 28, 42 need not be connected to the tank by way of a fitting 16; instead, those hoses could be separately connected to the tank.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A portable, pumpless wine expectorant vacuum device comprising:

a pressurizable rigid tank having a valved vacuum access adapted to be connected to a separate suction pump for drawing a vacuum in the tank;

a valved suction conduit connected to the tank for enabling wine expectorant to be sucked into the tank by the vacuum; and a valved drain on the tank for emptying the tank.

2. The device according to claim 1 wherein both the vacuum access and the suction conduit communicate with an upper portion of the tank; the drain communicating with a lower portion of the tank.

3. The device according to claim 1 further including a vacuum conduit communicating with the vacuum access, the vacuum conduit having a one-way valve disposed at a free end thereof.

4. The device according to claim 1 further including a drain conduit connected to the drain, the drain disposed at a lower portion of the tank.

5. The device according to claim 1 including a fitting connected to the tank and forming three ports, a first of the ports communicating with the tank interior, and second and third ones of the ports communicating with the first port, the suction conduit connected to the second port and having a first valve connected thereto, a vacuum conduit connected to the third port and having a second valve connected thereto.

6. The device according to claim 5 further including a drainage conduit connected to the drain and having a third valve connected thereto, the drain disposed adjacent a lower end of the tank.

7. The device according to claim 1 further including a wearable harness for supporting the tank on a user's back.

8. A method of disposing wine expectorant from a spit bucket, comprising the steps of:

A) connecting an interior of a portable pressurizable rigid tank to a vacuum pump and activating the pump for drawing a vacuum in the tank;

B) disconnecting the tank from the pump;

C) transporting the tank away from the pump and to the spit bucket;

D) inserting into the spit bucket an inlet end of a suction conduit connected to the tank and opening a passage from the inlet end to the tank interior to cause the vacuum in the tank to draw-in wine expectorant from the spit bucket; and E) transporting the tank to a discharge station and opening a drain of the tank to discharge the contents of the tank.

9. The method according to claim 8 wherein step A comprises drawing a vacuum of about thirty inches of mercury.

10. The method according to claim 8 wherein step C comprises transporting the tank on a user's back.

* * * * *